US006830433B2

(12) United States Patent
Birdsell et al.

(10) Patent No.: US 6,830,433 B2
(45) Date of Patent: Dec. 14, 2004

(54) TOWER FAN

(75) Inventors: Walter G. Birdsell, Marlborough, MA (US); David Feer, Wilton, NH (US); William J. Montague, Jr., Upton, MA (US)

(73) Assignee: Kaz, Inc., New York, NY (US)

( * ) Notice: Subject to any disclaimer, the term of this patent is extended or adjusted under 35 U.S.C. 154(b) by 12 days.

(21) Appl. No.: 10/212,464

(22) Filed: Aug. 5, 2002

(65) Prior Publication Data

US 2004/0022631 A1 Feb. 5, 2004

(51) Int. Cl.[7] ..... F04D 29/52
(52) U.S. Cl. ..... 416/110; 416/246; 416/247 R
(58) Field of Search ..... 416/110, 246, 416/247 R, 130, 100; 415/126, 127, 143, 214.1, 60

(56) References Cited

U.S. PATENT DOCUMENTS 3,120,340 A * 2/1964 Strumpell ..... 415/127
4,703,152 A * 10/1987 Shih-Chin ..... 416/110
5,266,004 A * 11/1993 Tsumurai et al. ..... 415/127
5,403,162 A * 4/1995 Chen ..... 416/246
5,658,130 A * 8/1997 Goldstein et al. ..... 416/100
5,660,605 A * 8/1997 Chan et al. ..... 454/202
6,049,655 A * 4/2000 Vazirani ..... 416/246
6,340,283 B1 * 1/2002 Hedger et al. ..... 416/247 R

* cited by examiner

*Primary Examiner*—Edward K. Look
*Assistant Examiner*—Richard A Edgar
(74) *Attorney, Agent, or Firm*—Darby & Darby

(57) ABSTRACT

An apparatus for the distribution of air includes a fan unit having a first and second portion, where the second portion is pivotable relative to the first portion about a common axis. A base supports the fan unit, and the fan unit may oscillate relative to the base. The fan unit may have a height greater than the width of the fan unit. The fan unit may also be capable of tilting relative to the base to a desired angle.

39 Claims, 8 Drawing Sheets

TOWER FAN

FIELD OF THE INVENTION

This invention relates to air distribution fans. In particular, the invention relates to fans being able to direct air in different directions by rotation, oscillation, and/or tilting.

BACKGROUND OF THE INVENTION

Artificially induced airflow has long been used to cool people in warm weather. With the mass production of small electric motors, floor and table mounted propeller style fans came into widespread use. Fans increase airflow, thereby increasing evaporative cooling from a person's skin.

The placement and size of fans may determine their effectiveness. If fans are too small, too close or only blow air in one direction, the cooling power of the fan may be limited. For example, if the zone covered by the fan is fixed, the user must reposition the fan so as to face a different area intended to be cooled. It has long been known to have mechanisms to oscillate fan assemblies from side-to-side, widening the air distribution and enlarging the zone of moving air. However, as the fan oscillates from side-to-side, the side from which the fan is moved no longer obtains the benefit of the moving air until the fan returns to that side. Also, the angular zone of the moved air is fixed and cannot be altered by the user. If it is desired to blow air in more than one direction at once, then typically two or more fans are used simultaneously. However, multiple fans require additional floor or table space. One solution has been to mount more than one fan on a vertical pole. However, use of multiple propeller fans mounted to a single pole can take up a large amount of space and generate an undesirable amount of noise.

SUMMARY OF THE INVENTION

The inventors have appreciated that typical air distribution fans do not provide sufficient flexibility for a user to adjust where and how the air is directed from the fan. Oscillating type fans can provide a changing air flow direction, but persons near the fan may experience discomfort due to the constantly changing amount of cooling air flow to their area. That is, a person may feel cool while the oscillating fan is directed toward the person, but may feel warm when the fan is directed another way.

In at least one aspect of the invention, an apparatus for air distribution, such as a fan, has a fan unit having a first portion and a second portion, the second portion being pivotally mounted to the first portion. The first and second portions are constructed and arranged to output an air flow. A base supports the fan unit and at least one of the first and second portions is capable of oscillating relative to the base.

In one embodiment, the fan unit has a height and a width, and the height may be greater than the width. The fan unit has a longitudinal axis along its length, the second portion may be pivotable about the longitudinal axis. The second portion may be pivotable in two different directions about the longitudinal axis of the fan unit. The first and second portions may include mating parts. The mating parts may have substantially the same cross-sectional shape, such that they mate substantially seamlessly. The second portion may be pivotable manually. A mechanical drive may pivot the second portion of the fan unit relative to the first portion. The apparatus may include a means for pivotally mounting the second portion to the first portion.

The fan unit may be capable of oscillating relative to the base. At least one of the first and second portions may be capable of oscillating relative to the base in two directions. The fan unit may be capable of oscillating relative to the base through a range of at least about 10° from a starting position in opposite directions. A control panel may be provided on the fan unit for controlling at least the oscillating movement of at least one of the first and second portions of the fan unit. A foot pedal may be provided remotely connected to the base for controlling at least the oscillating movement of at least one of the first and second portions of the fan unit. A remote control device may be provided for controlling at least the oscillating movement of at least one of the first and second portions of the fan unit.

In another embodiment of the invention, a pivotal connection may be provided to tilt the fan unit relative to the base. The pivotal connection may be provided at the connection between the base and the fan unit for tilting the fan unit relative to the base. The pivotal connection may be provided on the first portion of the fan unit for tilting the fan unit relative to the base. The base may include two parts rotatably joined together, one part having two pivot arms extending away from the base, the arms pivotally connected to the first portion of the fan unit to provide the pivotal connection for tilting the fan unit relative to the base and for oscillating the fan unit relative to the second part of the base. The fan unit may tilt at least about 1° in at least one direction from an original position.

In another aspect of the invention, an apparatus for distribution of air is provided having a fan unit having a first portion and a second portion. The second portion is pivotally mounted to the first portion about a longitudinal axis and the first and second portions are constructed and arranged to output an air flow. A base supports the fan unit and at least one of the first and second portions is capable of oscillating relative to the base. The fan unit has a height and a width, and the height is greater than the width.

In one embodiment, a means for pivotally mounting the second portion to the first portion is provided. The second portion may be pivotable manually. A mechanical drive may be provided to pivot the second portion of the fan unit relative to the first portion. A control panel may be provided on the fan unit for controlling at least the fan unit. A foot pedal may be remotely connected to the base for controlling at least the fan unit. The fan unit may be capable of oscillating relative to the base. A pivotable connection may be provided to tilt the fan unit relative to the base. The base may include two parts rotatably joined together, one part may have two pivot arms extending away from the base, the arms pivotally connected to the first portion of the fan unit to provide the pivotal connection for tilting the fan unit relative to the base and for oscillating the fan unit relative to the second part of the base. The fan unit may tilt at least about 1° in two opposite directions from an original position.

In yet another aspect of the invention, an apparatus for distribution of air is disclosed having a fan unit having a first portion and a second portion, the second portion being pivotally mounted to the first portion. The first and second portions are constructed and arranged to output an air flow. A base supports the fan unit and the fan unit is capable of tilting relative to the base.

In one embodiment, a means for pivotally mounting the second portion to the first portion is provided. The fan unit may be pivotally connected to the base for tilting the fan unit relative to the base. A pivotal connection may be provided on the first portion of the fan unit for tilting the fan unit relative to the base. The base may include two parts rotatably joined together, one part having two pivot arms extending away from the base, the arms pivotally connected to the first portion of the fan unit to provide the pivotal connection for tilting the fan unit relative to the base and for oscillating the fan unit relative to the second part of the base. The fan unit has a height and a width, and the height may be greater than the width. The fan unit has a longitudinal axis along a length of the fan unit, the second portion may be pivotable about the longitudinal axis. At least one of the first and second portions of the fan unit may be capable of oscillating relative to the base in two directions. A control panel may be provided on the fan unit for controlling at least the fan unit. A foot control pedal may be provided remotely connected to the base for controlling at least the fan unit. A remote control device may be provided for controlling at least the fan unit.

BRIEF DESCRIPTION OF THE DRAWINGS

The objects, advantages and features of aspects of the invention will be more clearly appreciated from the following detailed description, when taken in conjunction with the accompanying drawings, wherein like numbers are used for like features, in which.

DETAILED DESCRIPTION

As discussed above, illustrative embodiments in accordance with the invention provide an air distribution apparatus with a fan unit having two or more portions that may be pivoted relative to one another, such that they may be arranged to move air in different directions, thus eliminating the need for two or more separate fans. The fan unit is supported by a base and may be constructed and arranged to oscillate relative to the base. Moreover, the fan unit may also be constructed and arranged to be tiltable relative to the base.

The multiple portions of the fan unit may be connected together in such a way that the direction in which the portions of the fan unit move air may be changed relative to one another. For example, two portions of the fan unit may be joined by a rotatable coupling connection so that the units may be pivoted relative to each other about the rotatable coupling, allowing selective adjustment of the direction of air from each portion. Alternately, the rotatable coupling may allow one portion of the fan unit to pivot relative to another, such that only one portion moves. Portions of the fan unit may be connected by other rotary-type or pivoting connections, such as a bayonet-type connection, that allow adjustment of the direction in which the portions of the fan unit move air as will be appreciated by one of skill in the art.

Figure 3A:
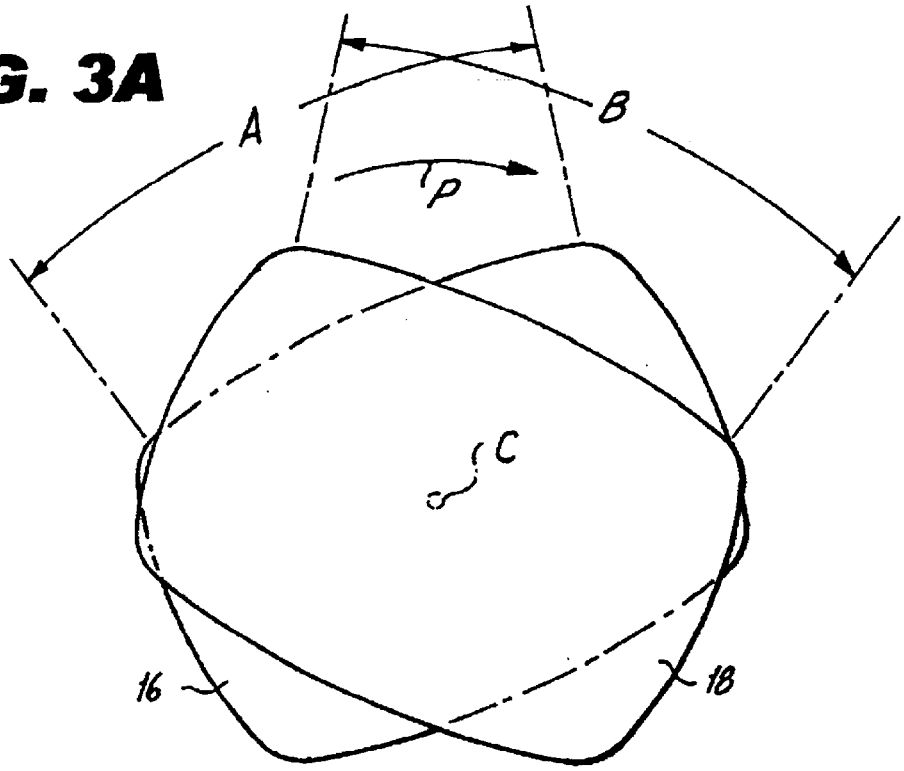
FIGS. 3A–C are schematic cross-sectional views of different embodiments of the fan unit of FIG. 2 taken along line 3—3, with one portion of the fan unit pivoted relative to the other.
Figure 3B:
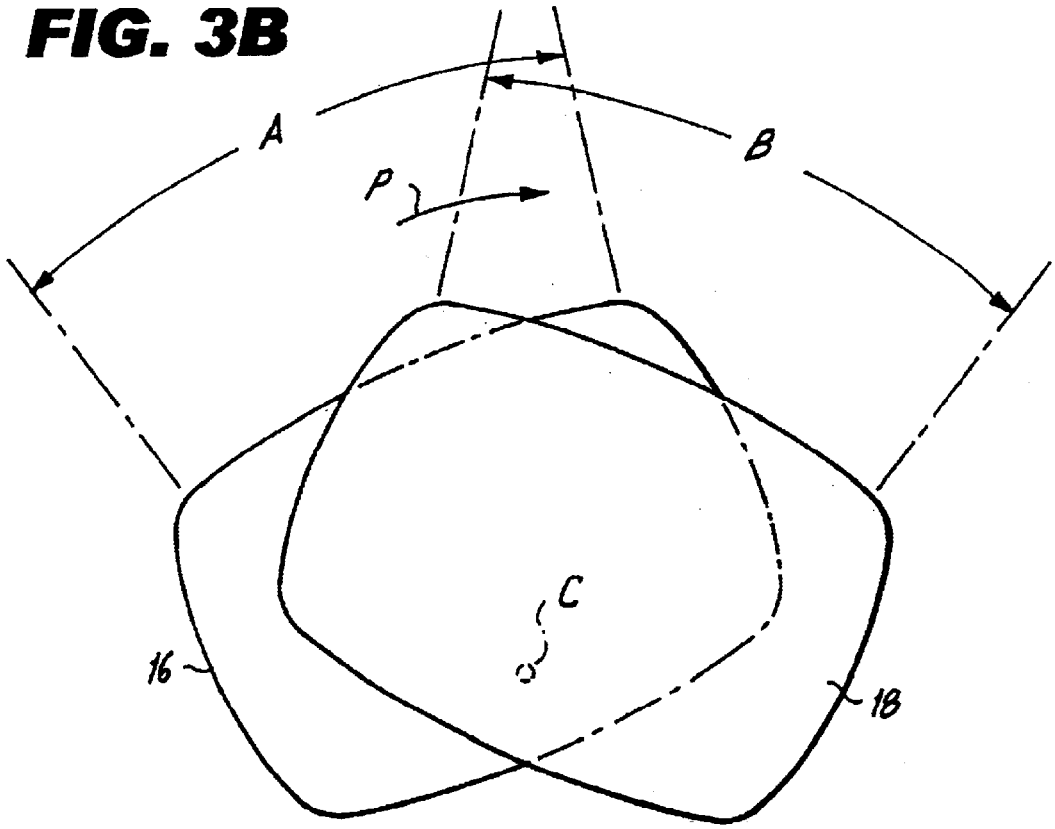
Figure 3C:
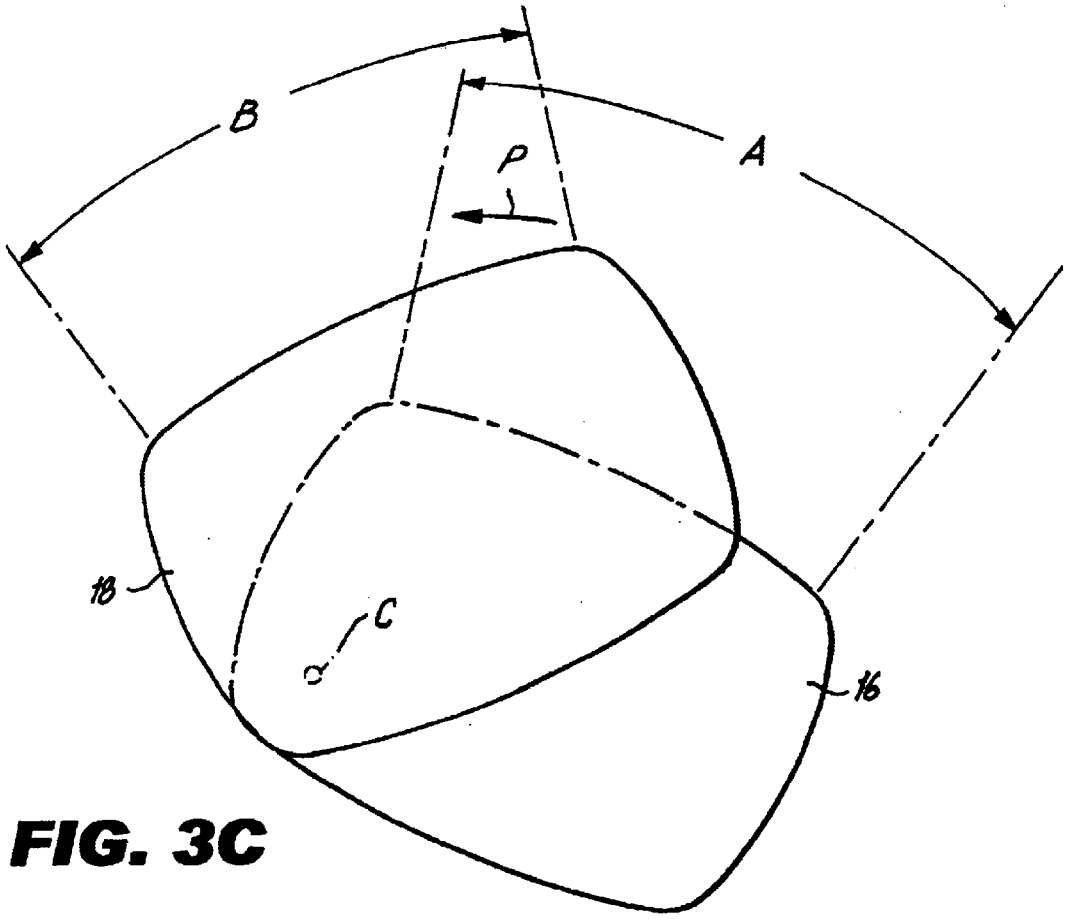
Figure 4:
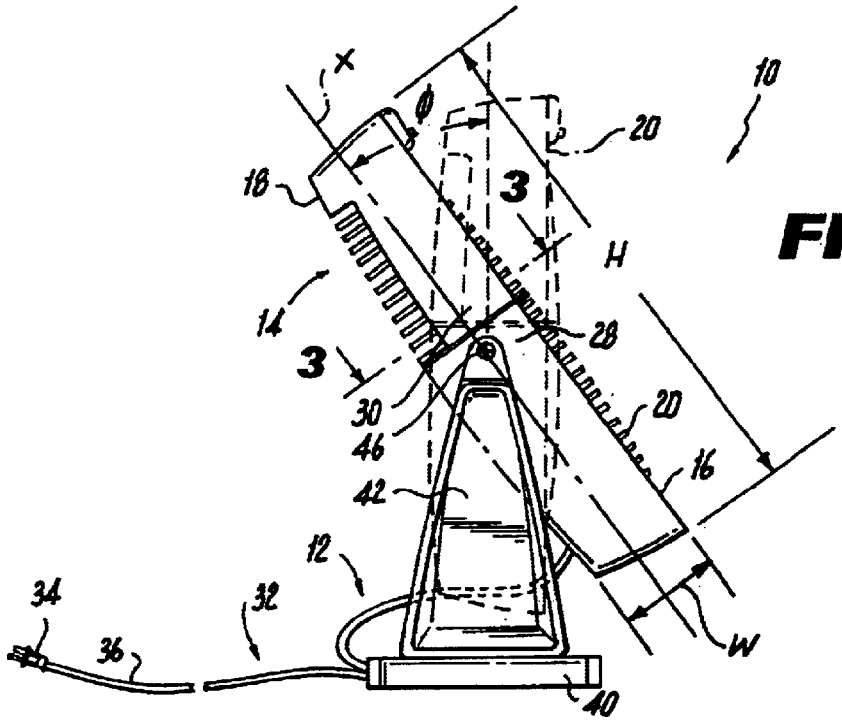
FIG. 4 is a side view of the fan of the embodiment of FIG. 1, showing the fan unit tilted relative to an original positional axis.
Figure 7A:
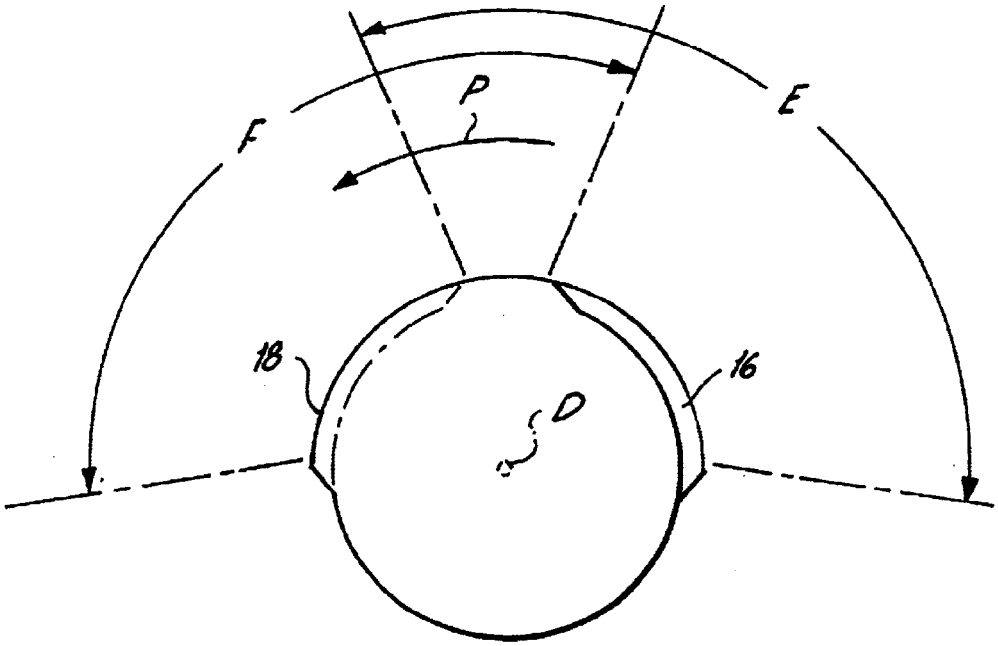
FIGS. 7A–B are schematic cross-sectional views of different embodiments of the fan unit of FIG. 5 taken along line 7—7, with one portion of the fan unit pivoted relative to the other.
Figure 7B:
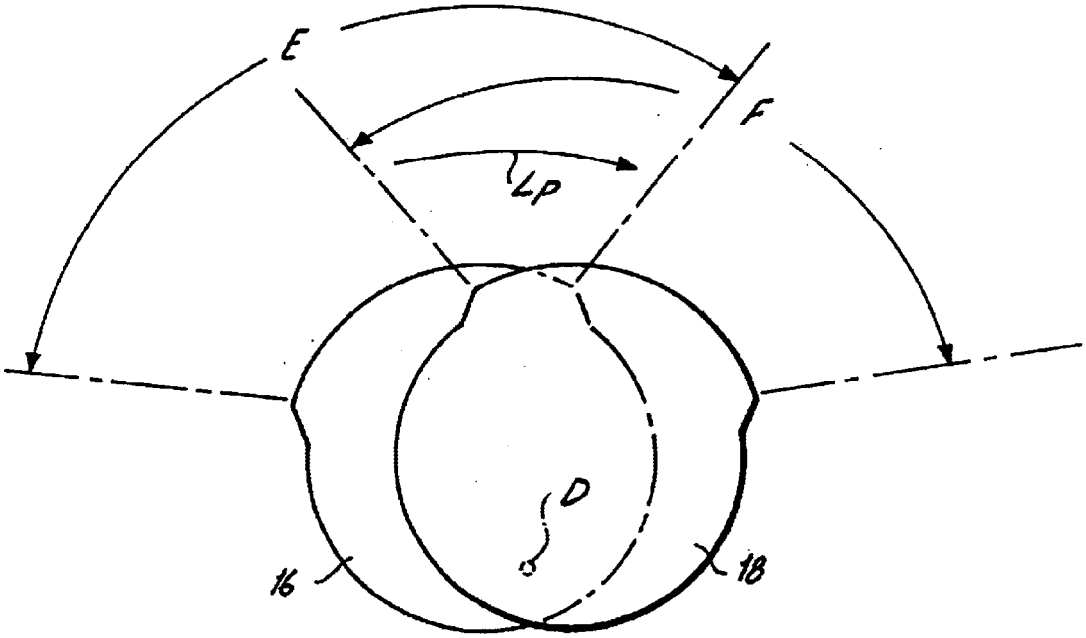
Figure 8:
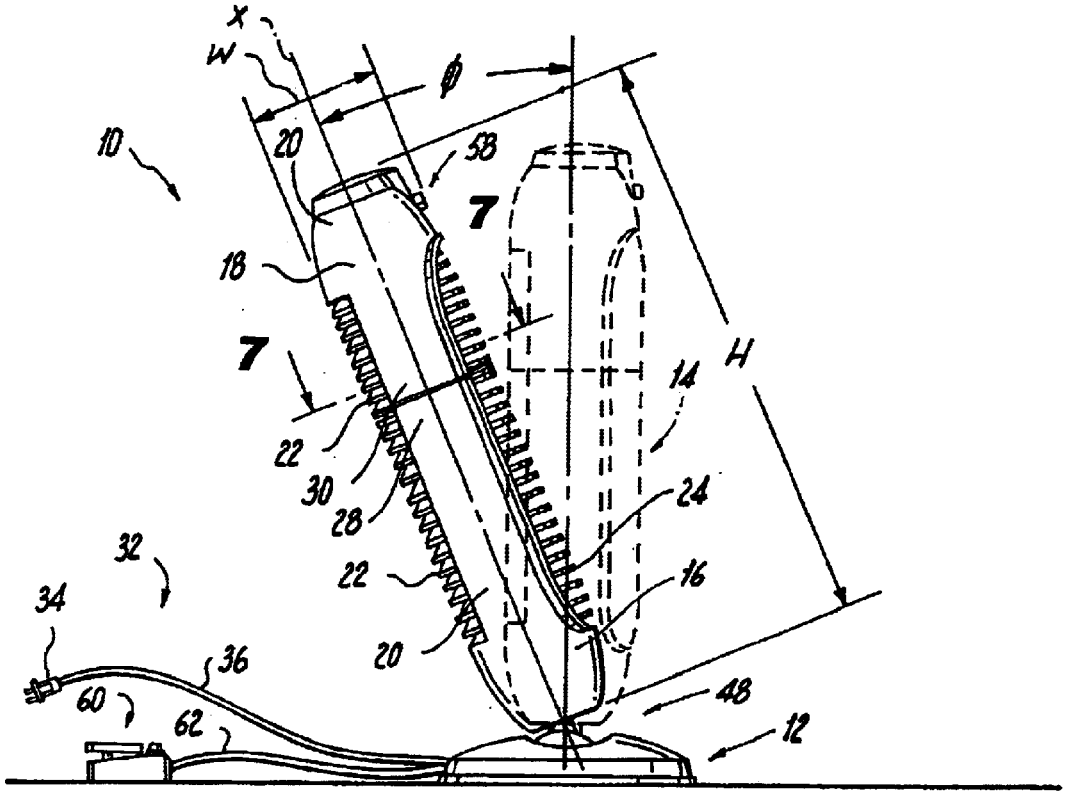
FIG. 8 is a side view of the embodiment of the fan of FIG. 5 with a tilting mechanism.

As shown in FIGS. 1–9, illustrative embodiments of a fan 10 feature a base 12 and a fan unit 14 having at least a first portion 16 and a second portion 18. Although the embodiments illustrated only show fan units 14 having a first and second portion 16 and 18, it will be appreciated that more than two portions may form the fan unit 14. Each portion 16 and 18 features a housing 20 and its own fan assembly (not shown) for the generation of air movement. As shown in FIGS. 4 and 8, preferably the fan unit 14 has an overall tower shape, as height H of the fan unit is greater than the fan unit's width W. The first and second portions 16 and 18 may be any desired size to form the entire fan unit 14. For example, the two portions 16 and 18 could be of equal size, or one could be larger than the other. As shown, the first and second portions 16 and 18 may have substantially the same cross-sectional shape and size where they mate so that the transition from the first portion 16 to the second portion 18 is seamless, making the fan unit 14 look like a single unit when the portions 16 and 18 are located to move air in the same direction. As shown, the first portion 16 is longer than the second portion 18 along the fan unit's longitudinal axis X, or its length.

Figure 5:
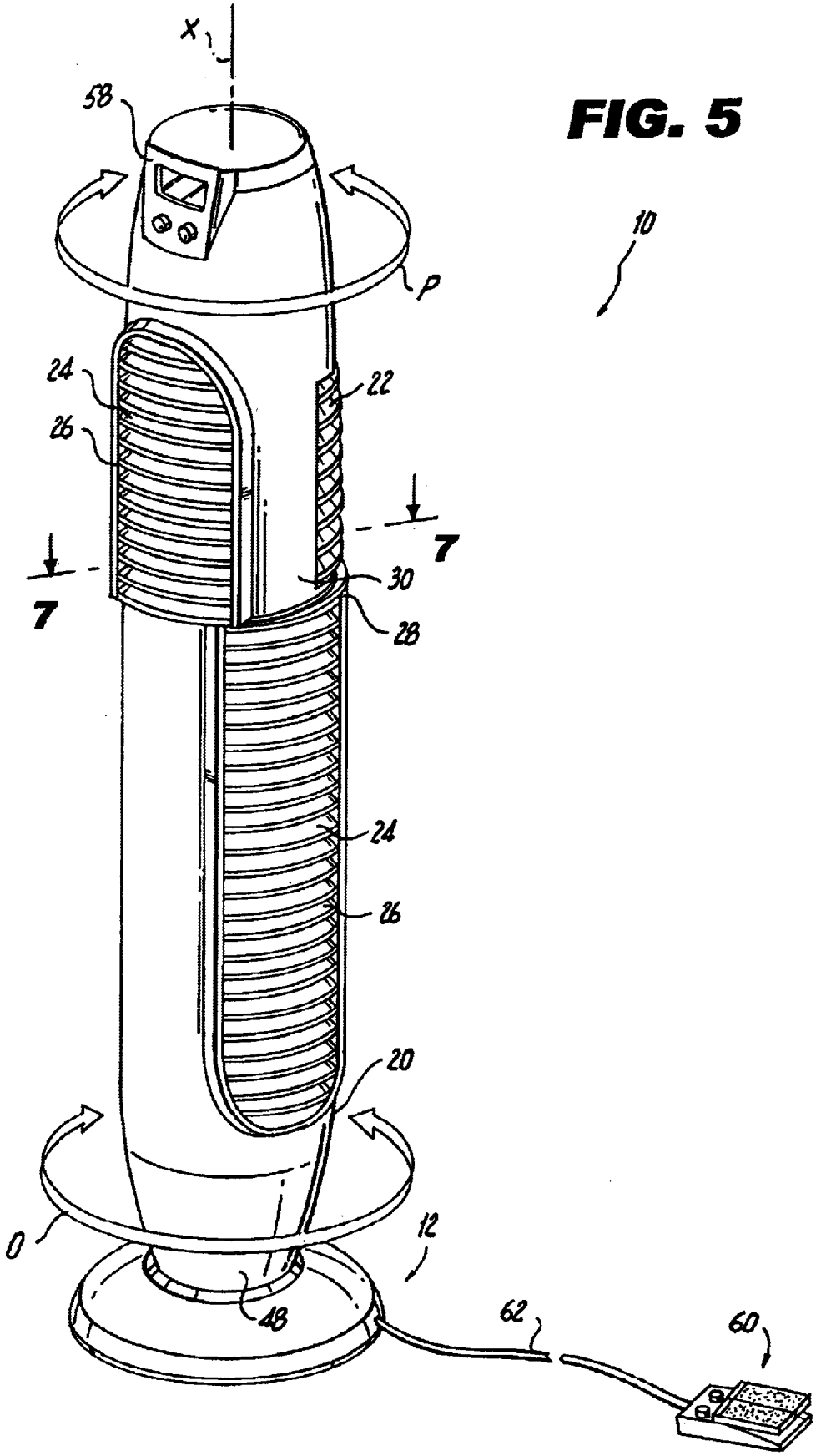
FIG. 5 is a perspective view of another embodiment of a fan according to the present invention, with one portion of the fan unit pivoted relative to the other and having a foot control pedal.
Figure 6:
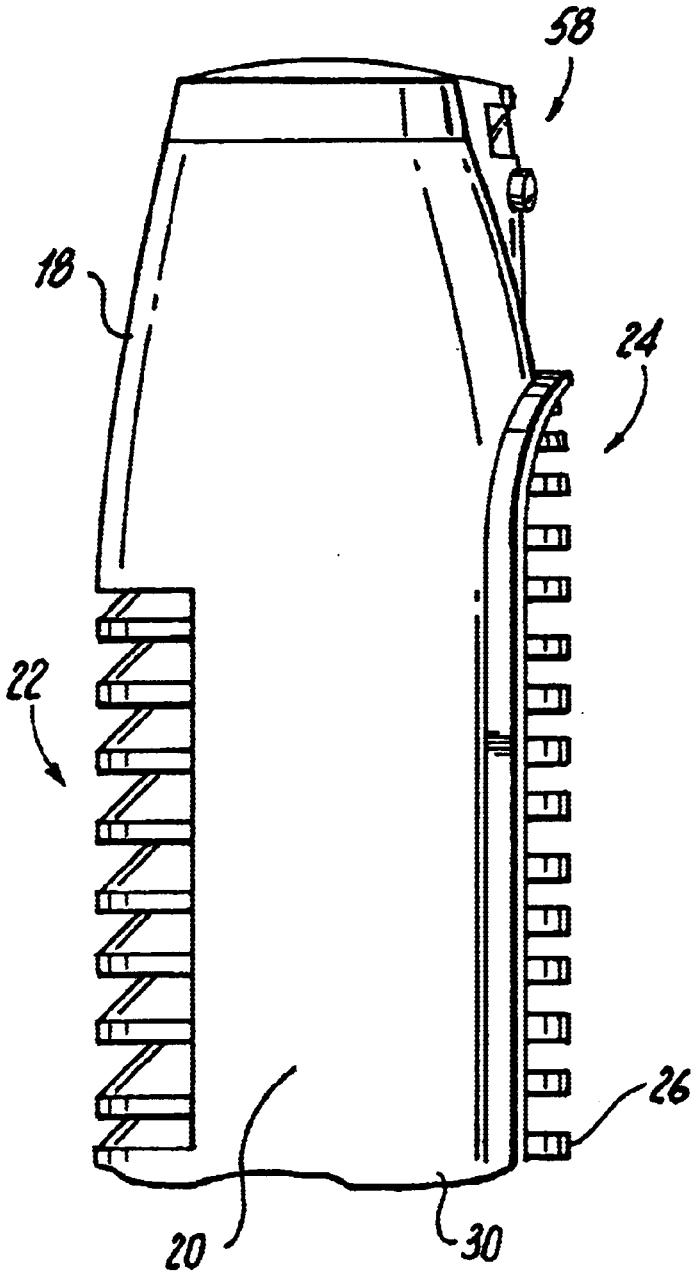
FIG. 6 is a side view of a second portion of the fan unit of FIG. 5.

As shown in FIGS. 1, 2, 5 and 6, the fan unit 14 has air inlets 22, which may be located on the back side of the fan unit 14 for taking in air. The front side features air outlets 24 provided with slats 26 for directing air that is moved through and out of the fan unit 14. It will be appreciated that the air inlets 22 and air outlets 24 may be provided in any suitable location on the portions of the fan unit 14. One embodiment of the second portion 18 of the fan unit 14 is shown in FIG. 6 with the air inlets 22 on the back side of the second portion 18 and the air outlets 24 with slats 26 on the front side of the second portion 18. The slats 26 may be movable to assist in redirecting air. In another embodiment, the air inlet could be provided on the bottom of a unit with the air outlet at the top. In a still further embodiment, the air inlet may include the whole lower section completely around the unit while the air outlet is also arranged completely around the unit, this time at a top portion.

Figure 2:
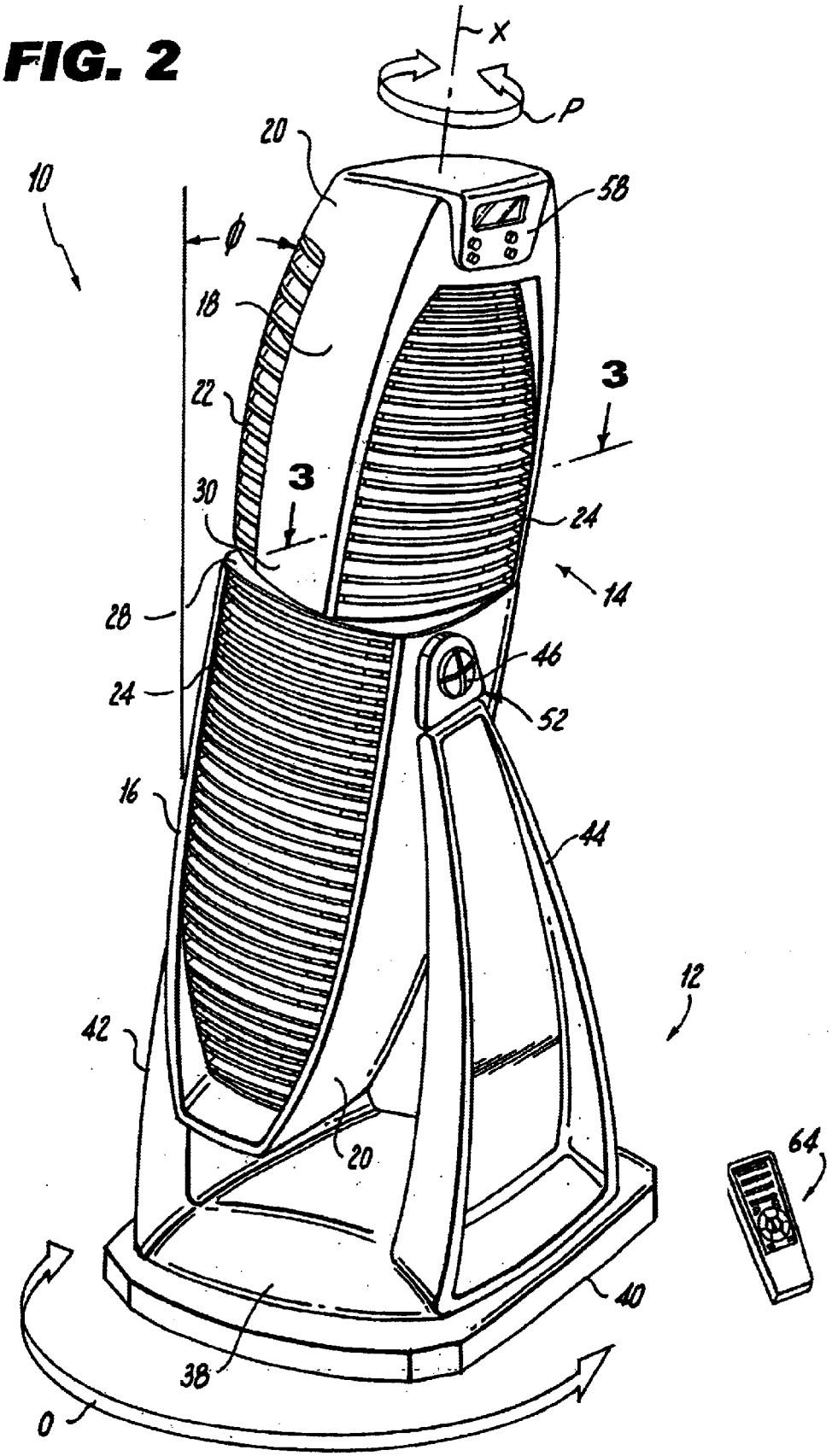
FIG. 2 is a perspective view of the fan of FIG. 1, with one portion of the fan unit pivoted relative to the other and having a remote control device.

As shown in FIGS. 2 and 5, the second portion 18 of the fan unit 14 may be rotatable or pivotable relative to the first portion 16 of the fan unit 14, about the longitudinal axis X or length of the fan unit 14. As shown, the second portion 18 may be pivoted in either direction about the longitudinal axis, to the right or left, such that air coming out of the second portion 18 is directed in a different direction than air coming out of the first portion 16. The second portion 18 may be caused to pivot relative to the first portion 16 in any suitable manner. Thus, the portions 16 and 18 of the fan unit 14 may move air in the same or different directions. The second portion 18 may be pivoted by any desired amount, and may be rotated 360° to return back to its original position relative to the first portion 16 of the fan unit 14. This arrangement may be preferred over oscillating fans since an approximately constant output of air may be directed toward a particular area, unlike oscillating fans which will change the direction in which air is moved. However, the fan unit 14 may also include an oscillating feature as described in more detail below.

As shown in the illustrated embodiments, the portions 16 and 18 of the fan unit 14 are stacked so that the second portion 18 of the fan unit 14 is on top of the first portion 16 of the fan unit 14. A first mating part 28 of the first portion is pivotally mated with the second mating part 30 of the second portion. Thus, the orientations of the air outlets 24 may be adjusted relative to one another about the longitudinal axis X by any desired amount. It will be appreciated, however, that the portions 16 and 18 may be located in any suitable manner to form the fan unit 14, and thus, the second portion 18 could be pivotable about any common axis. For example, the first and second portions 16 and 18 could be located side-by-side with the common axis being substantially along a horizontal axis.

As shown in FIGS. 3A–C, the cross-sectional shape of the first and second portions 16 and 18 may be substantially rectangular, although any suitable cross-sectional shape may be used. In FIG. 3A, the second portion 18 is shown pivoted in the direction of arrow P to the right relative to the first portion 16 about pivot point C to enlarge the zone of moved air from zone A to include both zones A and B. It will be appreciated that the pivot point C may be provided at any suitable location on the cross-sectional shape. As described below, FIGS. 3A–3C show the pivot point in different positions. As shown in FIG. 3A, the pivot point C is located at substantially the center of the rectangular cross-sectional shape. As shown in FIG. 3B, the second portion 18 is shown pivoted in the direction of arrow P to the right relative to the first portion 16 about pivot point C. The pivot point C is located at substantially the center of one side of the rectangular cross-sectional shape. In FIG. 3C, the second portion 18 is shown pivoted in the direction of arrow P to the left of the first portion 16 of the fan unit 14 about pivot point C. Pivot point C is located substantially in a corner of the rectangular cross-sectional shape.

Referring now to FIGS. 7A–B, the cross-sectional shape of the first and second portions 16 and 18 of another embodiment of the invention may be substantially circular, although any suitable cross-sectional shape may be used. In FIG. 7A, the second portion 18 is shown pivoted in the direction of arrow P to the left of the first portion 16 of the fan unit 14 about pivot point D to enlarge the zone of moved air to include both zones E and F. The pivot point E is located in substantially the center of the circular cross-sectional shape, although it may be located in any suitable location. In FIG. 7B, the second portion 18 is shown pivoted in the direction of arrow P to the right of the first portion 16 of the fan unit 14 about pivot point E. The pivot point E is located adjacent an edge of the circular cross-sectional shape.

The connection between the portions 16 and 18 of the fan unit 14 may be arranged in any suitable way, e.g., to allow pivotal adjustment in the relative positions of the portions of the fan unit 14. As discussed above, the portions 16 and 18 of the fan unit 14 may be joined by a rotatable coupling (not shown) so that the portions maybe pivoted relative to one another, or so that one portion may be pivoted relative to another portion, which may be fixed. The portions 16 and 18 of the fan unit 14 may also be connected by a rotary-type connection (not shown). For example, the portions 16 and 18 of the fan unit 14 may be connected at corresponding ends by a bayonet-type connection as is known in the art. The second portion 18 of the fan unit 14 may be pivoted relative to the first portion 16 manually (by hand). Alternatively, a mechanical drive (not shown) could be used to pivot the second portion 18 of the fan unit 14 relative to the first portion 16. Any suitable mechanical drive could be used.

As is known in the art, the fan unit 14 includes at least one fan assembly (not shown) that moves air into the air inlets 22 and out the air outlets 24. It will be understood that a single fan assembly, having a motor and a blower, may be provided in the fan unit 14, or a fan assembly, with a motor and blower, may be provided in each of the portions 16 and 18 of the fan unit 14. Alternately, a single motor could be provided with a blower for each portion 16 and 18 of the fan unit 14. It will be appreciated that any type of fan assembly may be used in the fan unit 14 to achieve movement of air. Although the fan unit 14 is arranged to move air, the fan unit 14 may also be arranged to perform any other suitable air conditioning function, including heating, humidifying, cooling, or any suitable combination of air conditioning functions.

As shown in FIGS. 4 and 8, the fan unit 14 may have an single electrical connector 32, which may be a plug 34 and wire connector 36 adapted to interface with a standard electrical wall outlet (not shown). Thus, each portion 16 and 18 of the fan unit 14 may be supplied with electrical power through the connector 32 and electrical connections between portions 16 and 18 of the fan unit 14. As shown in FIGS. 4 and 8, the connector 32 may run through the base 12 of the fan 10 to connect to the fan unit 14. The connector 32 may also be directly connected to the fan unit 14, instead of through the base 12. Of course, it will be appreciated that the portions 16 and 18 of the fan unit 14 may share a common power supply, such as a battery, solar or fuel cell, or other power source that may be located within the fan unit 14. Alternately, the portions 16 and 18 of the fan unit 14 may each have their own dedicated connector or power source.

Figure 1:
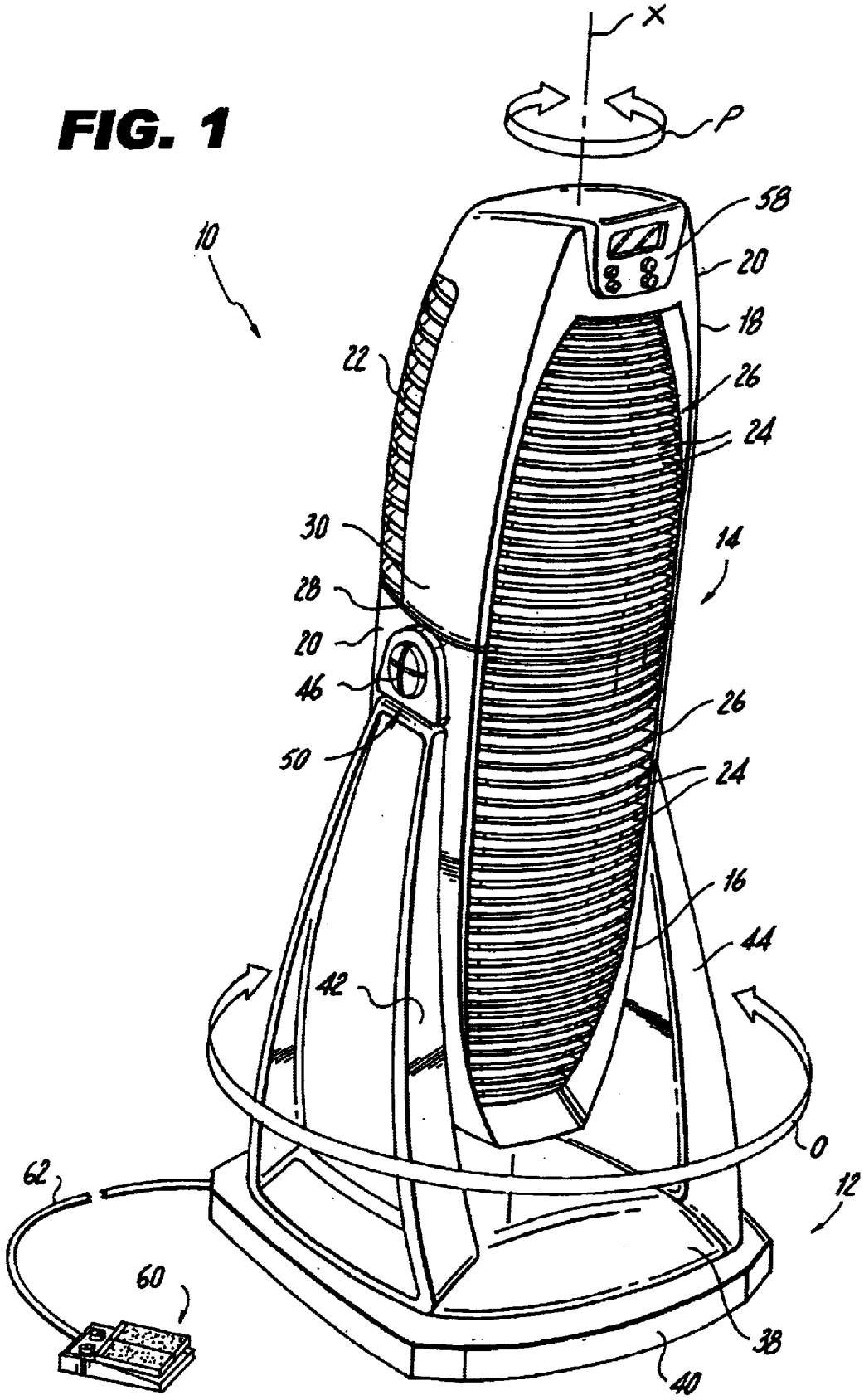
FIG. 1 is a perspective view of one embodiment of a fan according to the present invention.

As shown in the embodiments of FIGS. 1–9, the fan 10 may include an oscillating mechanism (not shown) for providing oscillating movement of the fan unit 14 relative to the base 12. Such a mechanism converts an input motion, such as a circular or rotary motion from a motor, into oscillation. For the purposes of this discussion, oscillation will be understood to refer to a repetitive motion, which causes the fan unit 14 to move air in a repeating pattern of directions. Within the context of a fan, oscillation is a motion wherein the fan unit's rotational axis sweeps through an arc, subsequently moving in reverse direction through the same arc, and returning to its original position. The fan unit 14 may also be able to oscillate 360° in one direction to come back to its original position. Any suitable oscillation mechanism may be used to effectively oscillate the fan unit 14 with respect to the base 12. It will also be understood that the portions 16 and 18 of the fan unit 14 may be made to oscillate relative to one another and/or the base 12. It will be appreciated that the fan need not include a separate base 12, but that one of the portions of the fan unit may support the fan in any suitable manner. Oscillating movement of the fan unit 14 is shown in FIGS. 1, 2 and 5 by arrow O.

As shown in the embodiment of FIGS. 1–4, the fan unit 14 is connected the base 12. The base 12 includes two parts 38 and 40 rotatably joined together, the first part 38 having two pivot arms 42 and 44 extending away from the base 12. The arms 42 and 44 are pivotally connected to the first portion 16 of the fan unit 14 for tilting the fan unit 14 relative to the base 12, as discussed further below, and for oscillating the fan unit 14 with the first part 38 of the base 12 relative to the second part 40 of the base 12. In the embodiment of FIG. 5, the fan unit 12 has a bottom 48 rotatably connected to the base 12 such that the fan unit 14 oscillates relative to the base 12.

As shown in the illustrated embodiments of the invention, the fan unit 14 may also be tiltable relative to the base 12. For example, a pivotal connection 46 may be provided at the connection between the base 12 and the fan unit 14, such that the fan unit 14 is capable of tilting relative to the base 12 from an original position by an amount to achieve a desired angle ϕ. The pivotal connection 46 may also be provided on the fan unit 14 itself, for example on the first portion 16 of the fan unit 14 as shown in the embodiment of FIGS. 1, 2 and 4. As described above, the base 12 may include two parts 38 and 40 rotatably joined together. The first part has two arms 42 and 44 extending upwardly with free ends 50 and 52. The free ends 50 and 52 are pivotally connected to the first portion 16 of the fan unit 14 to form the pivotal connection 46. The fan unit 14 may be tilted out of any original position (an original position shown in FIG. 4 in dotted lines for example purposes only) from this pivotal connection 46 by angle ϕ. It will be appreciated that the original position could be any suitable position for the fan unit, not merely a substantially vertical position as shown in dotted lines. The fan unit 14 may be tiltable by hand, or a mechanical drive (not shown) may be provided to mechanically tilt the fan unit 14. The fan unit 14 may be tiltable at least about 1° in at least one direction from its original position. Preferably, the fan unit 14 is tiltable to a maximum of 10° from its original position, although it will be understood that the fan unit 14 may be tiltable by any desired amount. The fan unit 14 may also be tiltable in a single direction, for example such that the fan unit 14 is tilted facing up to direct air upwards. As shown in the embodiment of FIGS. 1–2 and 4, the fan unit 14 is tiltable in two directions.

Figure 9:
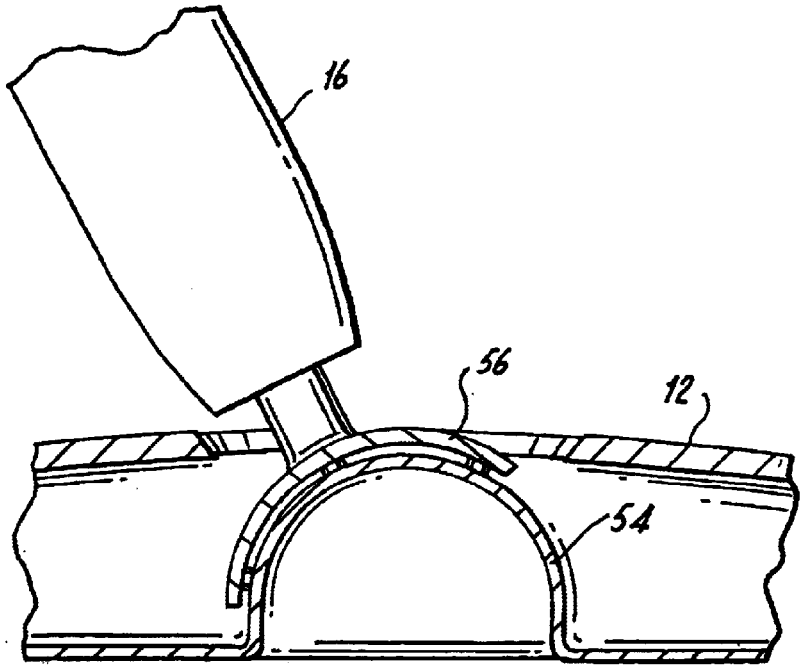
FIG. 9 is a cross-sectional side view of the tilting mechanism of FIG. 8.

Although the specific configuration as shown in FIGS. 1 and 2 is discussed with regard to tilting the fan unit 14 from its original position, it will be understood that any suitable mechanism for tilting the fan unit 14 from its original position may be used. For example, the embodiment of FIGS. 5–7 may also be constructed to tilt the fan unit 14 relative to the base 12. As shown in FIG. 8, the tilting may occur in any direction in 360° arc to an angle .phi. in any desired amount from any original position (an original position shown in FIG. 8 in dotted lines for example purposes only). As shown in FIG. 9, the fan unit 14 may have a concave portion 56 mating with a convex portion 54 within the base 12, which will allow the fan unit 14 to tiltably slide to different tilted positions within the 360° arc. It will be appreciated that any suitable tilting mechanism for the fan unit 14 may be used.

The fan unit 14 may also include controls to control the operation of the fan unit 14 or one or more of the portions 16 and 18 of the fan unit 14. The controls may include rotatable knobs, depressible buttons, voice or sound actuated switches, or any other suitable device to control the operation of the fan unit. In addition, one set of controls may be used to control both portions 16 and 18 of the fan unit 14. Thus, a user may turn the fan 10 on/off, adjust airflow rate, or the operational features of the fan 10 using a single set of controls, e.g., those on the second portion 18.

Although it could be provided anywhere, as shown in FIGS. 1–2, 5–6 and 8 a control panel 58 is provided at the top of the second portion 18 of the fan unit 14. In this manner, a user easily accesses the control panel 58 to control operation of the fan 10. It will be appreciated that the control panel 58 may be provided in any suitable location, for example the control panel 58 may be provided on the base 12 of the fan 10. As discussed above, the control panel 58 may feature a number of buttons for controlling the fan 10, such as an on/off button, various speed buttons to operate the fan 10 at at least two different speeds, and buttons to control the fan's movements, including oscillation and tilting of the fan unit 14 and pivoting of the second portion 18 of the fan unit 14. The controls may also feature a timer to turn the fan 10 off or on at desired times. When tilting of the fan unit 14 and/or pivoting of the second portion 18 of the fan unit 14 are done by one or more mechanical drives, the tilting or pivoting movements may be controlled through the control panel 58.

As shown in FIGS. 1 and 5, a foot pedal 60 may be provided remotely from the fan for controlling the fan 10. The foot pedal 60 may have similar controls to the control panel 58, and may be provided in addition to the control panel 58. The foot pedal 60 may be attached to the base 12 via a cord 62, or the foot pedal 60 may communicate with the fan 10 remotely without a cord. The controls on the foot pedal, which may include one or more buttons, may be actuated with the user's foot. Alternately, as shown in FIG. 2, a remote control 64 may be provided for controlling the fan 10. The remote control 64 may have similar controls to the control panel 64, and may be provided in addition to the control panel 64. Provision of either the foot pedal 60 or the remote control 64 would allow a user to remotely control the functions of the fan 10 without having to move to the fan 10 to use the control panel 58 on the fan 10 itself.

Modifications and improvements within the scope of this invention will occur to those skilled in the art. The above description is intended to be exemplary only. The scope of the invention is defined only by the following claims and their equivalents.

What is claimed is:

1. An apparatus for distribution of air, comprising:

a fan unit having a first portion and a second portion both arranged along a longitudinal axis, the second portion being pivotally mounted to she first portion about the axis, the first and second portions each being constructed and arranged to outpat an air flow; and a base that supports the fan unit, wherein the fan unit is capable of tilting relative to the base.

2. The apparatus of claim 1 further comprising: means for pivotally mounting the second portion to the first portion.

3. The apparatus of claim 1 wherein the fan unit is pivotally connected to the base for tilting the fan unit relative to the base.

4. The apparatus of claim 1 further comprising: a pivotal connection on the first portion of the fan unit for tilting the fan unit relative to the base.

5. The apparatus of claim 4 wherein:

the base includes two parts rotatably joined together, one part having two pivot arms extending away from the base, the arms pivotally connected to the first portion of the fan unit to provide the pivotal connection for tilting the fan unit relative to the base and for oscillating the fan unit relative so the second part of the base.

6. The apparatus of claim 1 wherein the fan unit has a height and a width, and the height is greeter than the width.

7. The apparatus of claim 1 wherein at least one of the first and second portions of the fan unit is capable of oscillating relative to the base in two directions.

8. The apparatus of claim 1 further comprising: a control panel on the fan unit for controlling at least the fan unit.

9. The apparatus of claim 1 further comprising; a foot control pedal remotely connected to the base for controlling at least the fan unit.

10. The apparatus of claim 1 further comprising: a remote control device for controlling at least the fan unit.

11. An apparatus for distribution of air, comprising:

a fan unit having a first portion and a second portion both arranged along a longitudinal axis, the second portion being pivotally mounted to the first portion about the axis, the first and second portions each being constructed and arranged to output an air flow; and a base that supports the fan unit, wherein at least one of the first and second portions is capable of vacillating relative to the base.

12. The apparatus of claim 11 wherein the first and second portions are constructed and arranged to each output a separate air flow.

13. The apparatus of claim 11 wherein the fan unit has a height and a width, and the height is greater than the width.

14. The apparatus of claim 11 wherein the second portion is pivotable in two different directions about the longitudinal axis of the fan unit.

15. The apparatus of claim 11 further comprising: mating parts of the first and second portions of the fan unit, and the mating parts have substantially the same cross-section shape, such that they mate substantially seamlessly.

16. The apparatus of claim 11 wherein the second portion is pivotable manually.

17. The apparatus of claim 11 further comprising: a mechanical drive to pivot the second portion of the fan unit relative to the first portion.

18. The apparatus of claim 11 further comprising: means for pivotally mounting the second portion to the first portion.

19. The apparatus of claim 11 wherein the first and second portions are capable of oscillating relative to the base.

20. The apparatus of claim 11 wherein at least one of the first and second portions is capable of oscillating relative to the base in two directions.

21. The apparatus of claim 20 wherein the fan unit is capable of oscillating relative so the base through a range of at least about 10° from a starting position in opposite directions.

22. The apparatus of claim 11 further comprising: a control panel on the fan unit for controlling at least the oscillating movement of at least one of the first and second portions of the fun unit.

23. The apparatus of claim 11 further comprising: a foot pedal remotely connected to the base for controlling at last the oscillating movement of at least one of the first and second portions of the fan unit.

24. The apparatus of claim 11 further comprising: a remote control device for controlling at least the oscillating movement of at least one of the first and second portions of the fan unit.

25. The apparatus of claim 11 further comprising: a pivotal connection to tilt the fan unit relative to the base.

26. The apparatus of claim 25 wherein the pivotal connection is provided at the connection between the base and the fan unit for tilting the fan unit relative to the base.

27. The apparatus of claim 25 wherein the pivotal connection is provided on the first portion of the fan unit for tilting the fan unit relative to the base.

28. The apparatus of claim 25 wherein:

the base includes two parts rotatably joined together, one part having two pivot arms extending away from the base, the arms pivotally connected to the first portion of the fan unit to provide the pivotal connection for tilting the fan unit relative to the base and for oscillating the fan unit relative to the second part of the base.

29. The apparatus of claim 25 wherein the fan unit tilts at least about 1° in at friar one direction from an original position.

30. An apparatus for distribution of air, comprising:

a fan unit having a first portion and a second portion both arranged along a longitudinal axis, the second portion being pivotally mounted to the first portion about the axis, the first and second portions being constructed and arranged to both output an air flow; and a base that supports the fan unit, at least one of the first and second portions being capable of oscillating relative to the base, wherein the fan unit has a height and a width, and the height is greater than the width.

31. The apparatus of claim 30 further comprising: means for pivotally mounting the second portion to the first portion.

32. The apparatus of claim 30 wherein the second portion is pivotable manually.

33. The apparatus of claim 30 further comprising: a mechanical drive to pivot the second portion of the fan unit relative to the first portion.

34. The apparatus of claim 30 further comprising a control panel on the fan unit for controlling at least the fan unit.

35. The apparatus of claim 30 further comprising: a foot pedal remotely connected to the base for controlling at least the fan unit.

36. The apparatus of claim 30 wherein the first and second portions are capable of oscillating relative to the base.

37. The apparatus of claim 30 further comprising: a pivotal connection to tilt the fan unit relative to the base.

38. The apparatus of claim 37 wherein: the base includes two parts rotatably joined together, one part having two pivot arms extending away from the base, the arms pivotally connected to the first portion of the fan unit to provide the pivotal connection for tilting the fan unit relative to the base and for oscillating the fan unit relative to the second part of the base.

39. The apparatus of claim 38 wherein the fan unit tilts at least about 1° in two opposite directions from an original position.

* * * * *